US011647869B2

(12) United States Patent
Wesley

(10) Patent No.: US 11,647,869 B2
(45) Date of Patent: May 16, 2023

(54) HINGED BATHTUB BENCH

(71) Applicant: United States Government as Represented by the Department of Veterans Affairs, Washington, DC (US)

(72) Inventor: Randall Wesley, Chicago, IL (US)

(73) Assignee: United States Government As Represented By The Department Of Veterans Affairs, Washington, DC (US)

( * ) Notice: Subject to any disclaimer, the term of this patent is extended or adjusted under 35 U.S.C. 154(b) by 125 days.

(21) Appl. No.: 16/951,326

(22) Filed: Nov. 18, 2020

(65) Prior Publication Data

US 2021/0145219 A1 May 20, 2021

Related U.S. Application Data

(60) Provisional application No. 62/937,608, filed on Nov. 19, 2019.

(51) Int. Cl.
*A47K 3/12* (2006.01)
*A47C 7/14* (2006.01)

(52) U.S. Cl.
CPC ..... *A47K 3/122* (2013.01); *A47C 7/14* (2013.01)

(58) Field of Classification Search
CPC ..... A47K 3/122; A47K 3/282; A47G 7/1003; A47C 7/14
See application file for complete search history.

(56) References Cited

U.S. PATENT DOCUMENTS 4,472,844 A * 9/1984 Mace ..... A47K 3/122 4/579
4,628,550 A * 12/1986 Walton ..... A61G 7/1019 4/560.1
2012/0192351 A1* 8/2012 Wechter ..... A47C 4/00 4/578.1
2014/0259361 A1* 9/2014 Nelson ..... A47K 3/122 4/579
2017/0303747 A1* 10/2017 Fortman ..... A47K 3/12
2020/0229653 A1* 7/2020 Williams ..... A47K 3/282

* cited by examiner

*Primary Examiner* — J C Jacyna
(74) *Attorney, Agent, or Firm* — Ballard Spahr LLP

(57) ABSTRACT

A bench assembly can be for use in a bathtub for showering. The bench assembly can comprise a frame that is configured to sit within a bathtub. A bench can be coupled to the frame. A pivotable platform assembly can comprise a platform support structure pivotably coupled to the frame and a platform coupled to the platform support structure. The pivotable platform assembly can be configured to bias against an upper rim of the bathtub.

20 Claims, 4 Drawing Sheets

HINGED BATHTUB BENCH

CROSS-REFERENCE TO RELATED APPLICATION

The application claims priority to and the benefit of the filing date of U.S. Provisional Patent Application No. 62/937,608, filed Nov. 19, 2019, the entirety of which is hereby incorporated by reference herein.

FIELD

The disclosure relates to seating in a bathtub and, in particular, to pivotal platforms for enabling a user to access the seating in the bathtub.

BACKGROUND

Many individuals use a bench in the shower, whether for safety or out of necessity. In a typical combination bathtub/shower, an individual must climb (often, from a wheelchair) over the rim of the bathtub to access the bench. Conventional platforms are sometimes used to assist the individual in traversing the rim of the bathtub in order to enable the individual to access the bench. One such example conventional platform is disclosed in U.S. Pat. No. 9,107,787 to Wechter. The platform is pivotably attached to the bench and comprises a pair of legs that fold down to rest against the ground/floor outside the bathtub. However, when the platform is in a lowered position, the shower curtain cannot be in a closed position. When the platform is in a raised position to allow the shower curtain to close, the platform acts as a vertical barrier that limits movement of the individual's arm.

SUMMARY

Described herein, in various aspects, is a bench assembly for use in a bathtub for showering. The bench assembly can comprise a frame that is configured to sit within a bathtub. A bench can be coupled to the frame. A pivotable platform assembly can comprise a platform support structure pivotably coupled to the frame and a platform coupled to the platform support structure. The pivotable platform assembly can be configured to bias against an upper rim of the bathtub.

A method of using the bench assembly can comprise using the platform to access the bench within the bathtub when the platform is in a lowered position and the pivotable platform assembly is biasing against an upper rim of the bathtub. The platform can be raised to allow a shower curtain to be positioned between the platform support structure and an upper rim of the bathtub. The shower curtain can be closed so that the shower curtain is positioned between the platform support structure and the upper rim of the bathtub. The platform can be lowered to the lowered position so that the platform support structure is resting on, and supported by the upper rim of the bathtub, with the shower curtain disposed between the pivotable platform assembly and the upper rim of the bathtub.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 2:
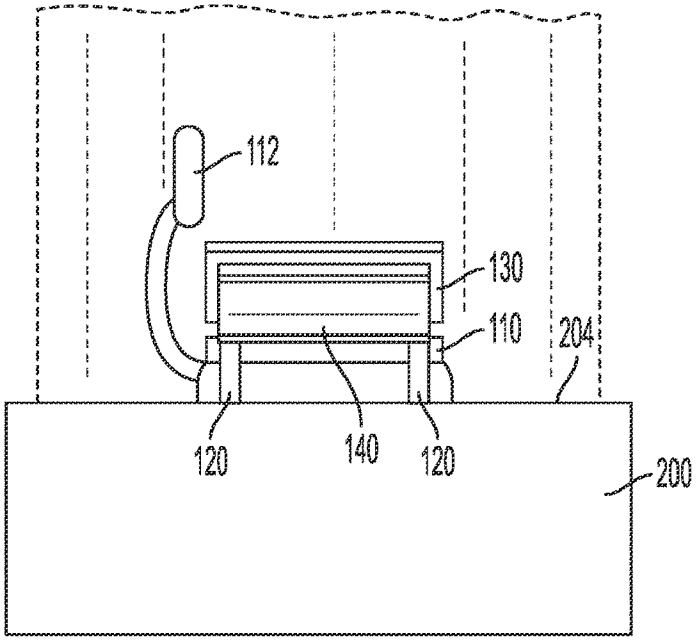
FIG. 2 is a side view of the bench as in FIG. 1, wherein the pivotal platform is in the raised position.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a hinge" can refer to one or more of such hinges, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") should be understood to include embodiments in which angles are within ten degrees, or within five degrees, or within one degree.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1-6, is a bench assembly 100 that is configured for use in a bathtub 200 having an interior 202, an upper rim 204, an inner wall 206, and an outer wall 208. The bench assembly 100 can be used to enable an individual (user) to safely and without difficulty traverse the upper rim of the shower as well as comfortably shower when seated on the bench assembly. The bench assembly 100 can comprise a frame 102 that can comprise a plurality of (e.g., four) legs 104. The legs 104 can be adjustable in length in order to configure the bench assembly 100 for various bathtub heights. In some aspects, the legs 104 can comprise telescoping components. In some exemplary embodiments, the legs 104 can each have an inner portion and an outer portion that are slidable relative to each other and lockable in different axial positions relative to each other via, for example, a fastener or detent. In these aspects, optionally, the inner portion can have one or more detents that engage through-holes along the length of the outer portion to lock the inner portion with respect to the outer portion to provide a leg having a desired length. Non-slip feet 106 can attach to bottoms of the legs 104. Optionally, the non-slip feet 106 can be removably attached to the legs 104. Alternatively, the feet 106 can be permanently secured to the legs. It is contemplated that the feet 106 can comprise any conventional non-slip or slip resistant material (e.g., polymer).

A bench 110 can attach to the frame 102 so that the frame supports the bench. The bench 110 can define a horizontal or generally horizontal upper surface. The bench 110 can optionally define contours that are shaped to ergonomically receive portions of a user's body (e.g., portions of the user's legs and buttocks). Optionally, the bench 110 can be padded or unpadded. The bench 110 can optionally define one or more through-holes that enable water to drain therethrough. A backrest 112 can couple to (optionally, be fixedly attached to) the frame 102 and/or the bench 110. Optionally, the backrest 112 can be coupled to the frame 102 and/or the bench 110 via one or more support members 114. The backrest 112 can optionally be perpendicular or generally perpendicular to the upper surface of the bench. The backrest 112 can engage a portion of the back to aid in trunk support. The backrest 112 can optionally be adjustable to various heights. For example, the one or more support members 114 can define vertically spaced holes that are configured to receive fasteners to couple the backrest 112 to the support members 114 in different vertical positions. In further aspects, a quick-disconnect clamp can enable decoupling and adjustment between the backrest 112 and the support members 114. In some optional aspects, the backrest 112 can comprise polymer or washable canvas. In these aspects, it is contemplated that the backrest can be removable for washing.

It can be understood that showers can be configured with the shower head on either longitudinal end of the bathtub. In other words, when facing the wall opposite the rim 204 that the individual must climb over to enter the bathtub, the shower head can be positioned on either the left or the right side. The bench assembly 100 can be selectively configured to face in either direction. For example, according to some optional aspects, the backrest 112 can be reversibly attached (e.g., via bolts and nuts) to extend upwardly from either end of the bench 110 (i.e., on the opposite ends with respect to the longitudinal dimension of the bathtub). In some optional embodiments, the backrest 112 and frame 102 can be coupled in rotationally symmetric fashion so that the backrest 112 can be swapped to the opposite end, thereby allowing the bench 110 to be configured for use with the user facing in either direction (i.e. toward either longitudinal end of the bathtub).

The bench assembly 100 can further comprise a handrail 190. The handrail 190 can couple to, for example, the frame, the bench, or both. Optionally, the handrail 190 can couple to the frame 102 or bench 110 below the upper surface of the bench. The handrail 190 can extend above the upper surface of the bench 110 and can optionally be positioned for use as an armrest and/or for the user to grip for support when moving into and out of the bathtub 200. The handrail 190 can optionally comprise a length of bent tubing. The handrail 190 can be configured to support the weight of the user, thereby enabling the user to grip the handrail when climbing onto and off of the bench 100. The handrail 190 can be positioned on the side of the bench opposite the platform 130 (i.e., on the side adjacent the wall that runs the longitudinal length of the bathtub). Accordingly, it is contemplated that the handrail 190 can be selectively removed and reattached on each side of the bench 110 (e.g., the left or right side relative to the user sitting on the bench and facing longitudinally in the bathtub). Optionally, the handrail 190 can be detachable (e.g., via removing bolts or via a quick-release).

Figure 1:
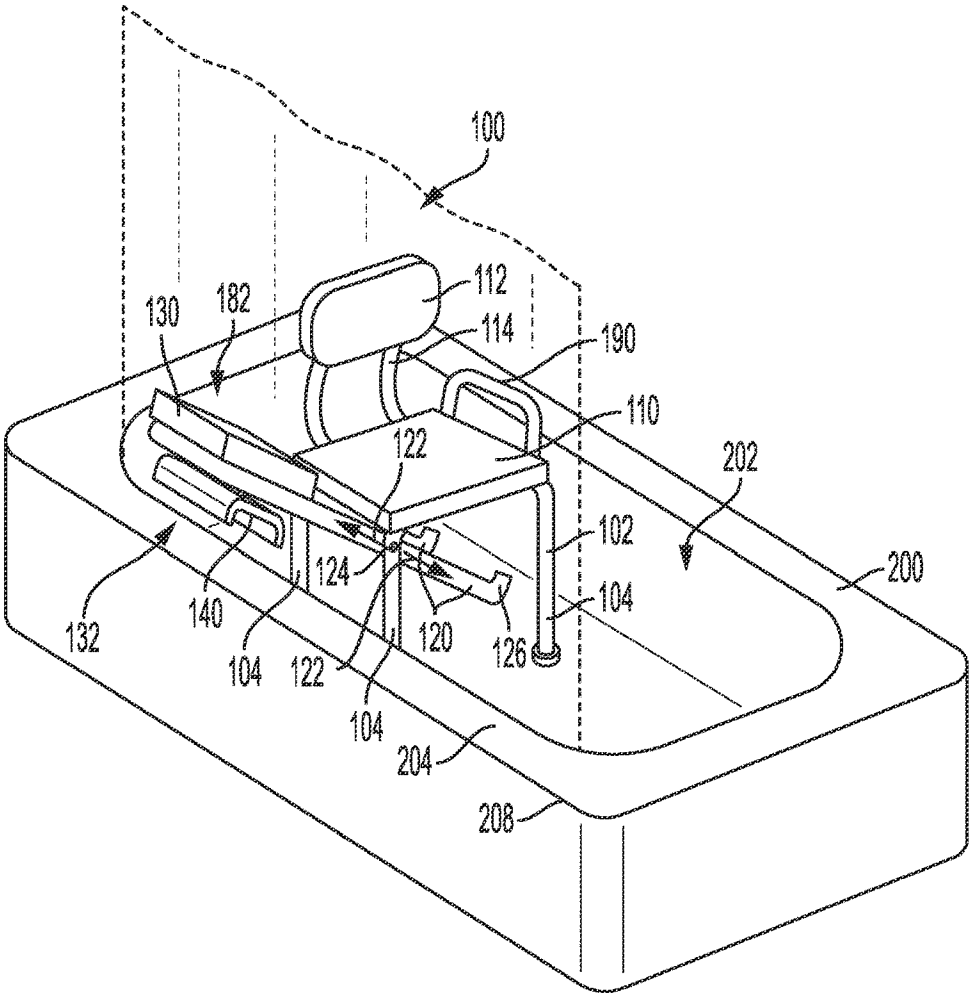
FIG. 1 is a front perspective view of a bench configured for use in a bathtub, in accordance with embodiments disclosed herein, wherein the bench has a pivotal platform in a raised position.
Figure 4:
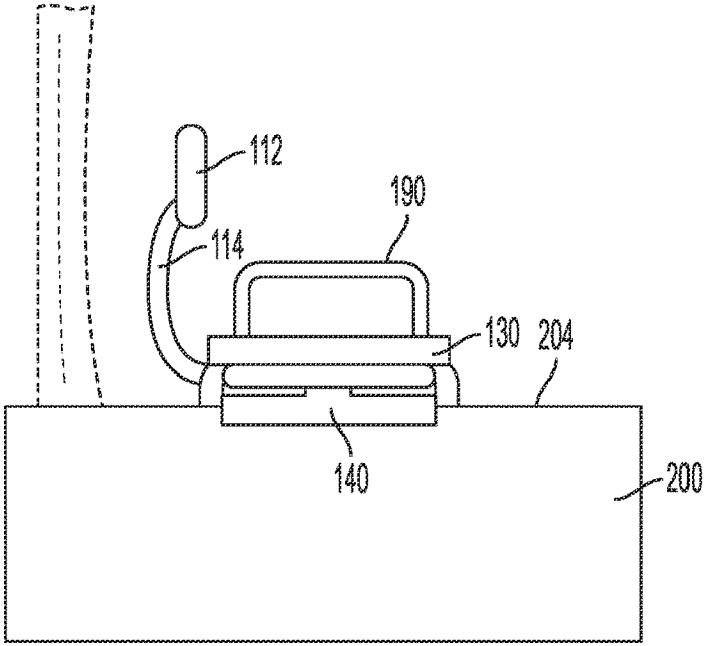
FIG. 4 is a side view of the bench of FIG. 1, wherein the pivotal platform is in the lowered position.
Figure 3:
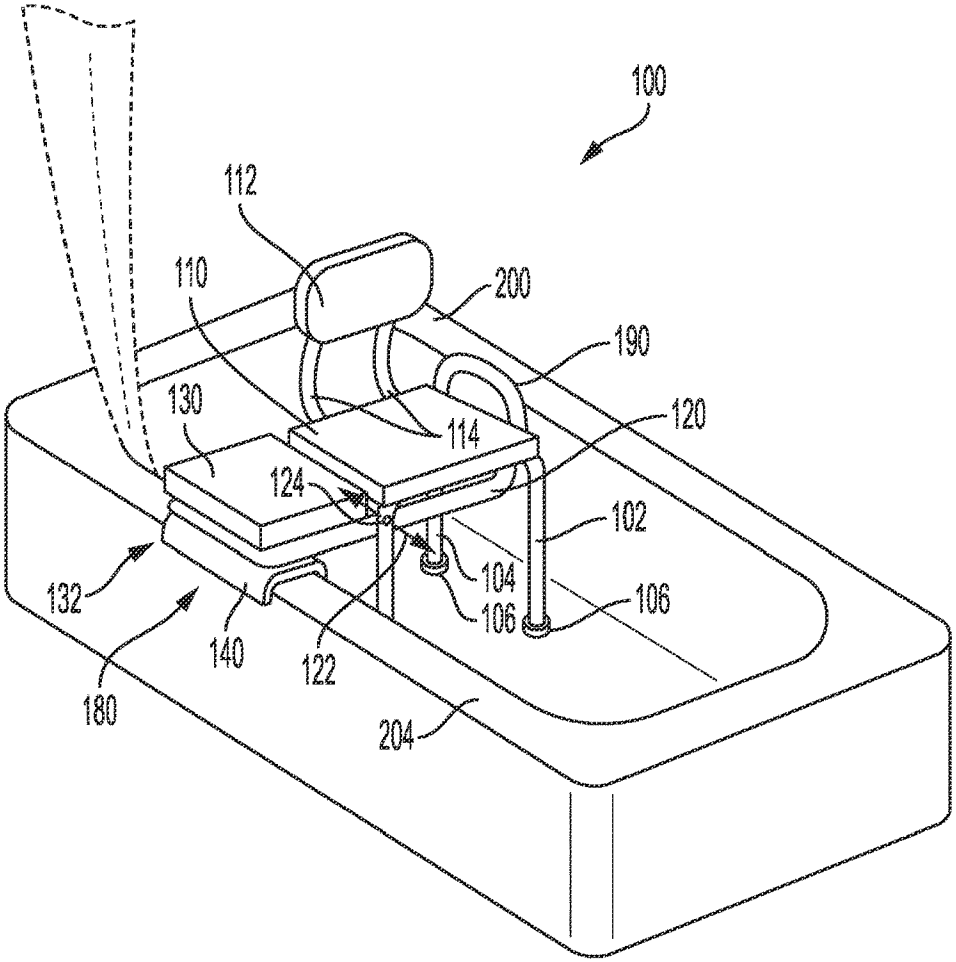
FIG. 3 is a front perspective view of the bench as in FIG. 1, wherein the pivotal platform is in a lowered position.
Figure 5:
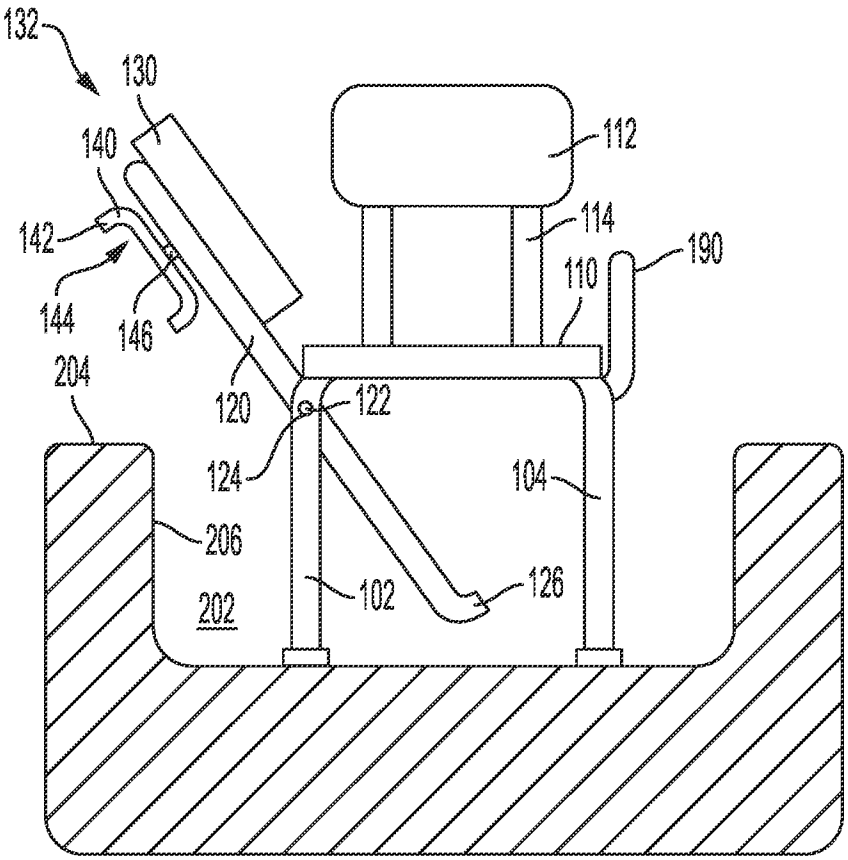
FIG. 5 is a front view of the bench as in FIG. 1 with the pivotal platform in a raised position.
Figure 6:
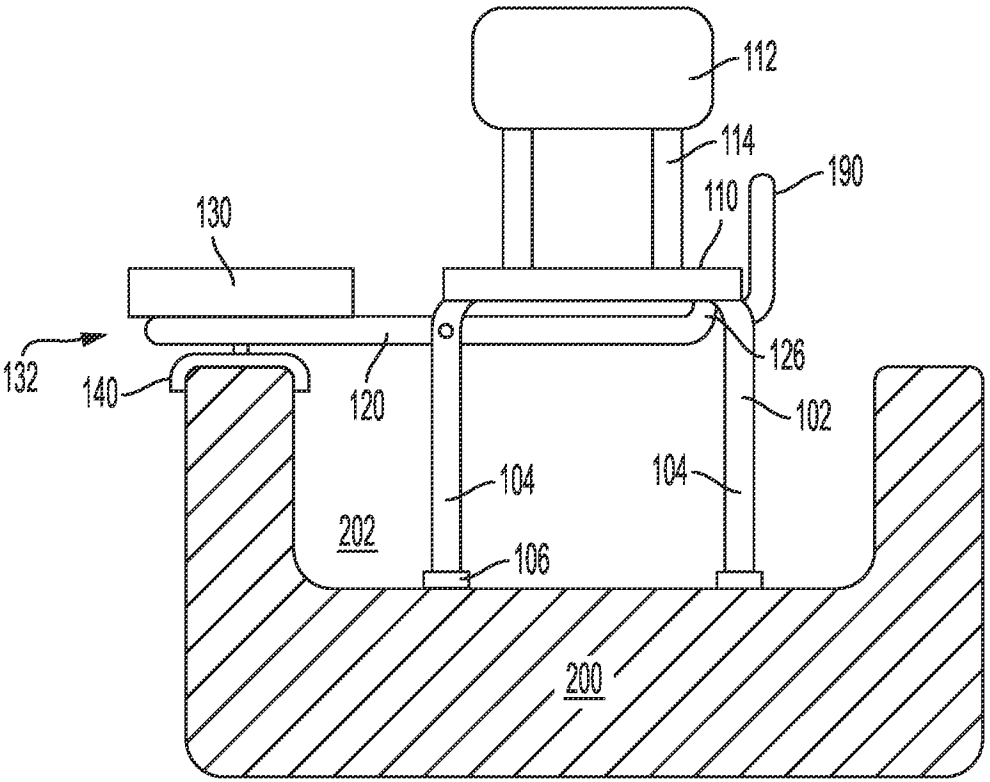
FIG. 6 is a front view of the bench as in FIG. 1 with the pivotal platform in a lowered position.

A pivotable platform assembly 132 can be coupled to the frame 102. The pivotable platform assembly 132 can comprise a platform 130 that is pivotably coupled to the frame 102. The platform 130 can be configured to be selectively positioned across the rim 204 of the bathtub 200. For example, optionally, one or more arms 120 (e.g., a pair of arms) can pivotably couple to the frame 102 about an axis 122 by one or more hinges 124. As shown in FIG. 1, it is contemplated that the arms 120 can be configured for pivotal motion relative to the axis 122, which can extend parallel or generally parallel to a longitudinal axis of the bathtub 200. The platform 130 can couple to the arms 120. In this way, the platform 130 can be pivotably coupled to the frame 102 about the axis 122, and the pair of arms 120 can define a platform support structure. In various optional embodiments, the platform 130 and one or more arms 120 can comprise separate components that are coupled together or can be integrally formed as a unitary, monolithic component. Optionally, the pivotable platform assembly 132 can include only one single arm 120.

In some optional aspects, each of the arms 120 can pivotably couple to respective legs 104 positioned on the side of the frame 102 proximate to the outside of the bathtub. For example, in some optional aspects, a respective pin can be received through corresponding through-holes in each arm 120 and a respective legs 104, with the pin being aligned with axis 122 so that the pins define at least a portion of the hinges 124 and form respective pivotal couplings between the arms 120 and the frame 102. In further optional aspects, the arms 120 can be pivotably coupled to the bench 110 or other portions of the frame 102.

Optionally, an engagement member 140 can couple to at least one of the platform 130 or the arms 120 for engagement with (e.g., biasing against) the upper rim 204 of the bathtub 200. In some optional embodiments, the engagement member 140 can comprise, or be embodied as, a compressible pad that is configured to elastically deform upon engagement with the upper rim of the bathtub. The pad can optionally comprise a water resistant, compressible, resilient material, such as, for example, foam, rubber, latex, polymer padding, or combinations thereof. The compressible pad can desirably reduce the amount of noise caused by engagement between the pivotable platform assembly 132 and the bathtub as well as distribute pressure across the upper rim to inhibit scratching or breaking of the bathtub. Optionally, the engagement member 140 can comprise opposing, downwardly facing projections 142 that define a receiving space 144 (in between the projections) for receiving at least a portion of the rim of the bathtub. It is contemplated that the depth of the receiving space (corresponding to the distance that the downwardly facing projections extend downwardly) can be minimized in order to limit the amount of shower curtain held outside the bathtub. For example, optionally, the downwardly facing projections can extend downwardly less than two inches or less than one inch in order to minimize the length of shower curtain outside of the tub, thereby allowing a lower edge of the shower curtain to be within the bathtub when the engagement member 140 is resting on the shower curtain. In further aspects, the engagement member 140 can be flat or convex. The engagement member 140 is optionally adjustably positionable along the longitudinal dimension of the arms 120 in order to accommodate bathtubs having varying widths. For example, according to optional aspects, the arms 120 can comprise a plurality of holes along their respective lengths, wherein the holes are configured to receive bolts (or other fasteners) therethrough, and the engagement member can be bolted (or otherwise fastened) to the arms 120 at select holes of said plurality of holes along the lengths of the arms. In various optional aspects, it is contemplated that the engagement member 140 can be adjustably coupled to the platform 130 (or the arms 120) so that the spacing between the underside of the engagement member 140 and the upper surface of the platform 130 can be adjusted. For example, an adjustable-length coupling 146 can couple the engagement member 140 to the platform 130. For example, in some optional aspects, the adjustable length-coupling 146 can comprise a spring detent that can be selectively positioned within a hole of a plurality of holes spaced longitudinally along a support member in order to select the length of the adjustable length-coupling 146. In this way, the pivotable platform assembly 132 can be adapted for bathtubs having different depths.

The platform 130 can be pivoted between a lowered position 180 (FIG. 3) and a raised position 182 (FIG. 1). In the raised position 182, the platform 130 can be above and pivoted away from the upper rim 204 of the bathtub 200 so that a shower curtain can be drawn between the bathtub and the bench assembly 100. When in the lowered position 180, the pivotable platform assembly 132 can bias against the upper rim of the bathtub. For example, for embodiments comprising an engagement member 140, the engagement member can bias against the upper rim of the bathtub. In further aspects, the arms 120 or the platform 130 can bias directly against the upper rim of the bathtub. Optionally, the platform 130 can be horizontal or substantially horizontal when in the lowered position 180. The platform 130 can be spaced from the bench 110 in order to provide sufficient clearance for the platform to pivot with respect to the bench. Optionally, this spacing can be minimized and selected based on the dimensions of the bench and platform.

In some optional aspects, when in the lowered position 180, portions of the arms 120 can be configured to bias against an underside of the bench 110 or frame 102 in order inhibit further pivoting of the pivotable platform assembly 132. For example, when the platform 130 is in the lowered position 180 (FIG. 3), the ends 126 of the arms 120 that are opposite the platform 130 can bias against the underside of the bench 110 and/or the frame 102. Simultaneously, the engagement member 140 can bias against the upper rim 204 of the bathtub 200. Thus, in the lowered position, the downward force provided by engagement member 140 can oppose (and, optionally, balance) the upward force provided by the ends 126 of the arms to result in a stable structure. Optionally, the ends 126 of the arms 120 can define an upward projection or define an L- or J-shape that is configured to engage the underside of the bench 110 and/or the frame 102. When the platform 130 is in the raised position 182 (FIG. 1), ends 126 of the arms 120 opposite the platform 130 can be spaced from the bench 110 and the frame 102 and can, optionally, be positioned underneath the bench 110.

In various optional aspects, some or all of the materials used in the bench assembly 100 can be water resistant and/or have a water resistant coating. For example, the materials of the bench assembly 100 (e.g., the frame, bench, platform, backrest, arms, etc.) can comprise non-corrosive, water-resistant materials, such as steel, stainless steel, aluminum, polymer, etc.

From outside the bathtub (e.g., in a wheelchair), a user can lower the platform 130 to the lowered position 180. When in the lowered position, the platform can extend across some or all of the upper rim 204 of the bathtub 200. In some optional embodiments, no part of the bench assembly 100 (e.g., no part of the pivotable platform assembly 132) can extend beyond the outer wall 208 of the bathtub 200 when the platform 130 is in the lowered position 180. In further optional embodiments, when the bench assembly 100 is disposed in the bathtub and the platform 130 is in the lowered position 180, no part of the bench assembly 100 (e.g., no part of the pivotable platform assembly 132) can extend beyond the outer wall 208 of the bathtub 200 by more than about two inches, more than about four inches, or more than about six inches, or more than about eight inches. In this way, the shower curtain can be positioned to extend around the distal-most portion of the platform assembly 132 and still have its lower edge positioned within the interior 202 of the bathtub 200. Optionally, in these embodiments the engagement member 140 (e.g., pad) can extend beyond the outer wall 208 of the bathtub 200 by about 2 inches to about 4 inches, and the platform can extend beyond the outer wall of the bathtub by about 0 inches to about 8 inches. The user can use the platform 130 (e.g., sliding across it and onto the bench 110) to traverse the upper rim of the bathtub. Once seated on the bench 110, the user can raise the platform to the raised position 182 in order to permit closing of the shower curtain. The user can then lower the platform 130 back to the lowered position 180 so that a portion of the closed shower curtain is between the upper rim of the bathtub and the engagement member 140. In this way, the platform can be lowered and out of the way of the individual on the bench, while allowing the shower curtain to remain closed during use of the shower.

Although the foregoing invention has been described in some detail by way of illustration and example for purposes of clarity of understanding, certain changes and modifications may be practiced within the scope of the appended claims.

What is claimed is:

1. An apparatus for use with a bathtub having opposed ends spaced along a longitudinal axis, the apparatus comprising:

a frame that is configured to sit within the bathtub;

a bench coupled to the frame;

a platform pivotably coupled to, and in contact with, the frame, wherein the platform is pivotable about and between a raised position and a lowered position, wherein, in the lowered position, the platform is configured to extend across an upper rim of the bathtub; and a platform support structure that is coupled to the frame, wherein the platform support structure is configured to support the platform relative to the frame, wherein the apparatus is configured for use within the bathtub in spaced relation, along the longitudinal axis of the bathtub, to each of the opposed ends of the bathtub.

2. The apparatus of claim 1, wherein the platform support structure comprises a pair of arms.

3. The apparatus of claim 1, wherein, when the frame is disposed in the bathtub and the platform is in the lowered position, the platform is configured to extend no more than eight inches beyond an outer edge of the upper rim of the bathtub.

4. The apparatus of claim 3, wherein, when the frame is disposed in the bathtub and the platform is in the lowered position, the platform is configured to extend no more than four inches beyond an outer edge of the upper rim of the bathtub.

5. The apparatus of claim 1, wherein the platform support structure comprises a compressible pad that is configured to deform upon engagement with the upper rim of the bathtub.

6. The apparatus of claim 1, wherein the platform support structure is configured to simultaneously engage the upper rim of the bathtub and at least one of the bench or the frame.

7. The apparatus of claim 5, wherein the platform support structure comprises at least two arms, wherein each arm of the at least two arms comprises a back end that is opposite the platform, wherein the back end of each arm of the at least two arms is configured to engage an underside of at least one of the bench and the frame when the platform support structure is in engagement with the upper rim of the bathtub.

8. The apparatus of claim 1, further comprising a backrest, wherein the backrest is coupled to at least one of the bench or the frame.

9. The apparatus of claim 8, wherein the bench has a first end and an opposing second end, wherein the backrest is configured to be reversibly coupled to the at least one of the bench or the frame so that the backrest can selectively be positioned at the first end of the bench and at the second end of the bench.

10. The apparatus of claim 1, wherein the platform support structure defines a receiving space, wherein the receiving space is configured to receive at least a portion of the upper rim of the bathtub.

11. The apparatus of claim 1, wherein the platform is configured to rest on a portion of a shower curtain that is disposed between the platform and the upper rim of the bathtub.

12. The apparatus of claim 1, further comprising a handle that is coupled to at least one of the bench or the frame.

13. The apparatus of claim 12, wherein the handle is configured for selective decoupling and reattachment on opposing sides of the bench.

14. A method comprising:

positioning, within a bathtub having opposed ends spaced along a longitudinal axis, an apparatus so that the apparatus is in spaced relation, along the longitudinal axis of the bathtub, to each of the opposed ends of the bathtub, the apparatus comprising:

a frame that is configured to sit within the bathtub;

a bench coupled to the frame, wherein the frame comprises a plurality of legs that are configured to independently support the bench;

a platform pivotably coupled to the frame, wherein the platform is pivotable about a raised position and a lowered position, wherein, in the lowered position, the platform is configured to extend across an upper rim of the bathtub; and a platform support structure that is coupled to the frame, wherein the platform support structure is configured to support the platform relative to the frame;

using the platform to access the bench within the bathtub when the platform is in a lowered position and the platform support structure is biasing against an upper rim of the bathtub;

raising the platform to allow a shower curtain to be positioned between the platform and an upper rim of the bathtub;

closing the shower curtain so that the shower curtain is positioned between the platform and the upper rim of the bathtub;

lowering the platform to the lowered position, with the shower curtain disposed between the platform and the upper rim of the bathtub.

15. The method of claim 14, wherein when the platform support structure is biasing against the upper rim of the bathtub, no portion of the apparatus extends outwardly from an outer wall of the bathtub by more than six inches.

16. The method of claim 14, wherein, when the shower curtain is disposed between the platform and the upper rim of the bathtub, a lower edge of the shower curtain is disposed within an interior of the bathtub.

17. The apparatus of claim 1, wherein the frame comprises a plurality of legs, wherein the legs are configured to support an entirety of a load on the bench.

18. The apparatus of claim 1, wherein the frame comprises four legs.

19. The apparatus of claim 1, wherein the frame is configured to be received entirely within an area surrounded by an interior wall of the bathtub.

20. The apparatus of claim 1, wherein the platform support structure is configured to support the platform without contacting a floor outside of the bathtub.

* * * * *